US012078361B2

(12) United States Patent
Caloca et al.

(10) Patent No.: US 12,078,361 B2
(45) Date of Patent: Sep. 3, 2024

(54) COMBINATION GAS BURNER ASSEMBLY

(71) Applicant: WHIRLPOOL CORPORATION, Benton Harbor, MI (US)

(72) Inventors: Victor Gerardo Caloca, Guanajuato (MX); Alok C. Deshpande, Maharashtra (IN); Patrick J. Duffy, St. Joseph, MI (US); Ken E. Johnson, Owasso, OK (US); Victor H. Manrique, St. Joseph, MI (US); Ashish Mittal, Maharashtra (IN)

(73) Assignee: Whirlpool Corporation, Benton Harbor, MI (US)

( * ) Notice: Subject to any disclaimer, the term of this patent is extended or adjusted under 35 U.S.C. 154(b) by 23 days.

(21) Appl. No.: 17/711,145

(22) Filed: Apr. 1, 2022

(65) Prior Publication Data

US 2023/0313999 A1 Oct. 5, 2023

(51) Int. Cl.
*F24C 3/08* (2006.01)
*F23D 23/00* (2006.01)

(52) U.S. Cl.
CPC ..... *F24C 3/085* (2013.01); *F23D 23/00* (2013.01)

(58) Field of Classification Search
CPC ..... F24D 23/00; F24C 3/085
USPC ..... 126/39 R, 39 E
See application file for complete search history.

(56) References Cited

U.S. PATENT DOCUMENTS

| | | | | |
|---|---|---|---|---|
| 2,781,779 | A | 2/1957 | Kindl | |
| 6,332,460 | B1 | 12/2001 | Paesani | |
| 7,291,009 | B2 | 11/2007 | Kamal et al. | |
| 7,527,495 | B2 | 5/2009 | Yam et al. | |
| 8,011,358 | B2 | 9/2011 | Galindo et al. | |
| 8,978,637 | B2 * | 3/2015 | Ryu | F24C 3/085 126/39 R |
| 9,557,063 | B2 | 1/2017 | Cadima | |
| 9,664,394 | B2 | 5/2017 | Cadima | |
| 9,677,768 | B2 | 6/2017 | Cadima | |
| 10,274,202 | B2 | 4/2019 | Cadima | |
| 10,393,371 | B2 * | 8/2019 | Manrique | F23N 1/00 |
| 10,767,857 | B2 | 9/2020 | Manrique et al. | |
| 2016/0025347 | A1 * | 1/2016 | Cadima | F24C 3/085 126/215 |
| 2016/0025348 | A1 | 1/2016 | Cadima | |

FOREIGN PATENT DOCUMENTS

| | | | |
|---|---|---|---|
| EP | 2551589 | A2 | 1/2013 |
| JP | S5253885 | U | 4/1977 |
| WO | 2008141916 | A2 | 11/2008 |

* cited by examiner

*Primary Examiner* — Vivek K Shirsat
(74) *Attorney, Agent, or Firm* — Price Heneveld LLP

(57) ABSTRACT

A combination gas burner assembly includes a first burner forming a first profile shape and a second burner positioned above the first burner. The second burner forms a second profile shape different from the first profile shape. The first burner and the second burner form a perimeter of the gas burner assembly. The first profile shape overlaps with the second profile shape forming an overlapping portion of the perimeter.

19 Claims, 11 Drawing Sheets

COMBINATION GAS BURNER ASSEMBLY

FIELD OF THE DISCLOSURE

The present disclosure generally relates to a burner assembly for a cooking appliance and, more specifically, to a combination gas burner assembly that varies in proportions over different profile shapes.

SUMMARY OF THE DISCLOSURE

According to one aspect of the present disclosure, a combination gas burner assembly is disclosed. The assembly comprises a first burner forming a first profile shape and a second burner positioned above the first burner. The second burner forms a second profile shape different from the first profile shape. The first burner and the second burner form a perimeter profile of the gas burner assembly. The first profile shape overlaps with the second profile shape forming overlapping portions of the perimeter.

According to another aspect of the present disclosure, a combination gas burner assembly is disclosed. The assembly comprises a first burner forming a first profile shape. The first burner comprises ports extending up about the first profile shape in a first arrangement. A second burner is positioned above the first burner and forms a second profile shape different from the first profile shape. The second burner comprises second burner ports extending about the second profile shape in a second arrangement. The first burner and the second burner form a perimeter profile of the gas burner assembly. The first profile shape overlaps with the second profile shape forming an overlapping portion of the perimeter. The first arrangement and the second arrangement of the burner ports extend consistently along the overlapping portion of the first profile shape and the second profile shape.

According to yet another aspect of the present disclosure, a combination gas burner assembly comprises a first burner forming a first profile shape and a second burner positioned above the first burner. The second burner forms a second profile shape different from the first profile shape. The first burner and the second burner form a perimeter of the gas burner assembly. The first profile shape overlaps with the second profile shape forming an overlapping portion of the perimeter. The first profile shape is an elongated shape with a larger vertically facing surface area over the cooking surface than the second profile shape. The first profile shape extends outward from the second profile shape along a major axis of the elongated shape. The overlapping portion of the perimeter over which the second profile overlaps the first profile shape is vertically stacked, such that the second burner ports of the second burner extend above the first burner ports of the first burner.

These and other features, advantages, and objects of the present disclosure will be further understood and appreciated by those skilled in the art by reference to the following specification, claims, and appended drawings.

Figure 1:
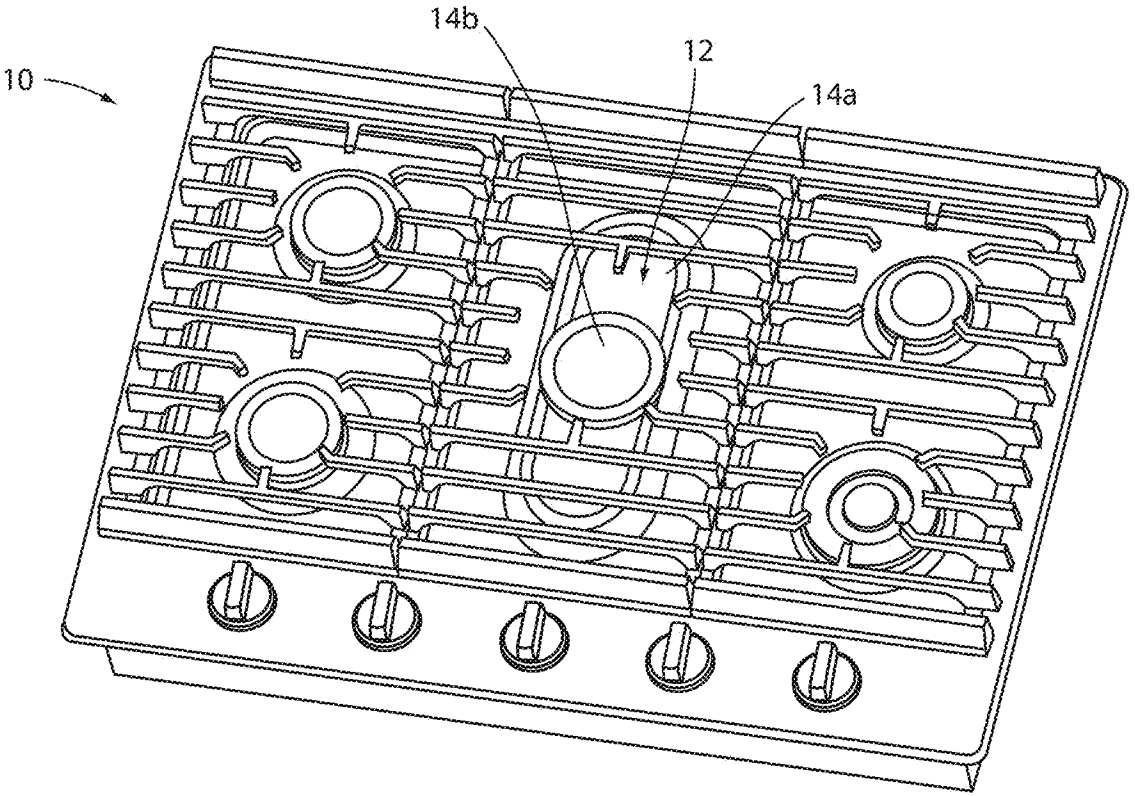
FIG. 1 is a projected view of a burner assembly for a cooking appliance.

The components in the figures are not necessarily to scale, emphasis instead being placed upon illustrating the principles described herein.

DETAILED DESCRIPTION

The present illustrated embodiments reside primarily in combinations of method steps and apparatus components related to a burner assembly for a cooking appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Referring to FIGS. 1, 2A, 2B, and 3, the disclosure provides for a cooking appliance 10 that includes a burner assembly 12 with an elongated cooking profile designed to flexibly heat cookware (e.g., griddles, pots, pans, etc.) with varying proportions. The burner assembly 12 may correspond to a gas burner that provides for variable distribution of proportions over which flames are distributed as well as providing significant heat delivery. These aspects are provided through a design that is easy to clean, such that the ease of maintenance of the burner assembly 12 is not limited by the flexibility. In various implementations, the burner assembly 12 includes a first burner 14*a* forming a first profile shape 16*a* and a second burner 14*b* forming a second profile shape 16*b*. In operation, each of the first burner 14*a* and the second burner 14*b* may be activated alone or in combination to deliver heat to overlying cookware positioned over the burner assembly 12.

Figure 2B:
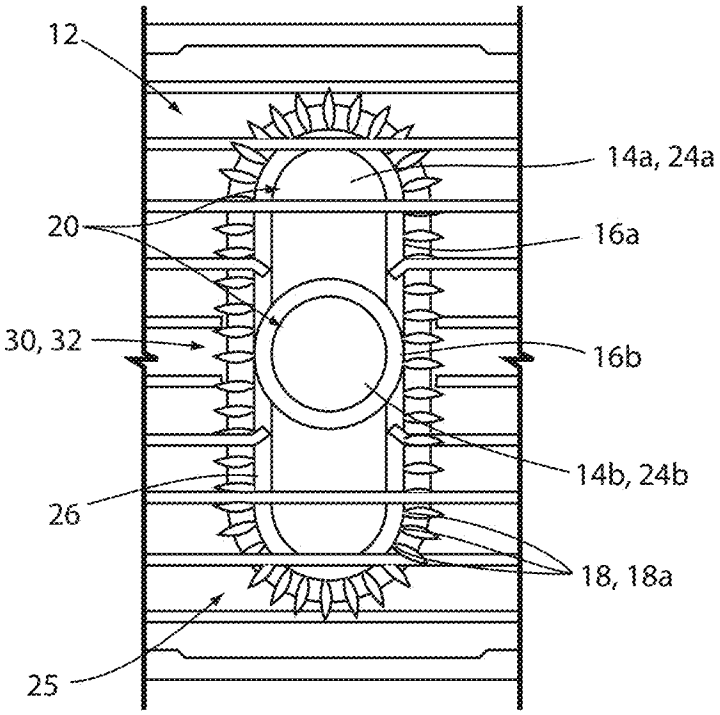
FIG. 2B is a top plan view of a burner assembly in a second configuration.
Figure 2A:
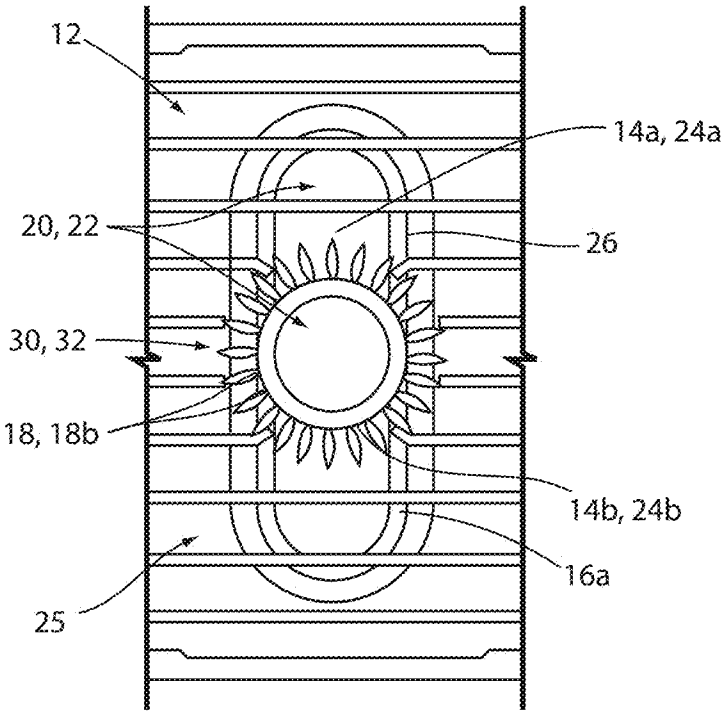
FIG. 2A is a top plan view of a burner assembly in a first configuration.

Each of the profile shapes 16*a*, 16*b* provide for a consistent perimeter from which the gas and corresponding flames are evenly distributed, as demonstrated in FIGS. 2A and 2B. This configuration provides for even heat distribution about each of the profile shapes 16*a*, 16*b* for improved cooking performance. As shown in FIG. 2, the uninterrupted heat distribution is provided by delivering fuel to burner ports 18 or flame ports evenly distributed about the each of the first and second profile shapes 16*a* and 16*b* without interruption. The even and uninterrupted distribution of the burner ports 18 may be provided by the arrangement of the burners 14*a*, 14*b* and may further provide the added benefit of maintaining an elevationally or vertically contiguous surface 20 formed by a union 22 of a first cap 24*a* of the first burner 14*a* and a second cap 24*b* of the second burner 14*b*. As shown in FIGS. 2A and 2B, the vertically contiguous surface 20 formed by the caps 24*a* and 24*b* is free of vertically oriented openings or spaces that could otherwise trap and collect cooking debris throughout operation. As discussed herein, the term elevational and similarly described openings or features as discussed in this disclosure correspond to features that are exposed from a top or vertically offset position relative to gravity.

For example, a vertically or elevationally exposed feature as described may be exposed facing upward from a burner assembly and create openings into which cooking debris may fall. In various embodiments, the disclosure provides for the vertically or upward-directed contiguous surface 20 that is free of openings that form vertically facing spaces, pockets, or openings within or between the profile shapes 16*a*, 16*b* or a perimeter 26 of the burner assembly 12. That is, while each of the caps 24*a*, 24*b* is implemented as separate components in the exemplary embodiment illustrated, from an elevational perspective, as shown in FIGS. 2A and 2B, the surface area of the caps 24*a*, 24*b* is uninterrupted over the union 22 of the profile shapes 16*a*, 16*b* within the perimeter 26 of the burner assembly 12. In this configuration, the burner assembly 12 ensures that cooking debris that fall onto the burner assembly 12 are deflected from the contiguous surface 20 formed by the caps 24*a* and 24*b*, such that debris are displaced to the cooktop surface 25 outside the perimeter 26 of the burners 14*a*, 14*b*. Though the caps 24*a* and 24*b* of the burner assembly 12 create the physical barrier to deflect the cooking debris, the combined capability of the burner assembly 12 to deliver the even and uninterrupted heat distribution about the profile shapes 16*a*, 16*b* in combination with the contiguous surface 20 may be provided by a stacked configuration 30 of the burners 14*a*, 14*b* as further discussed in reference to FIGS. 3-5.

Figure 3:
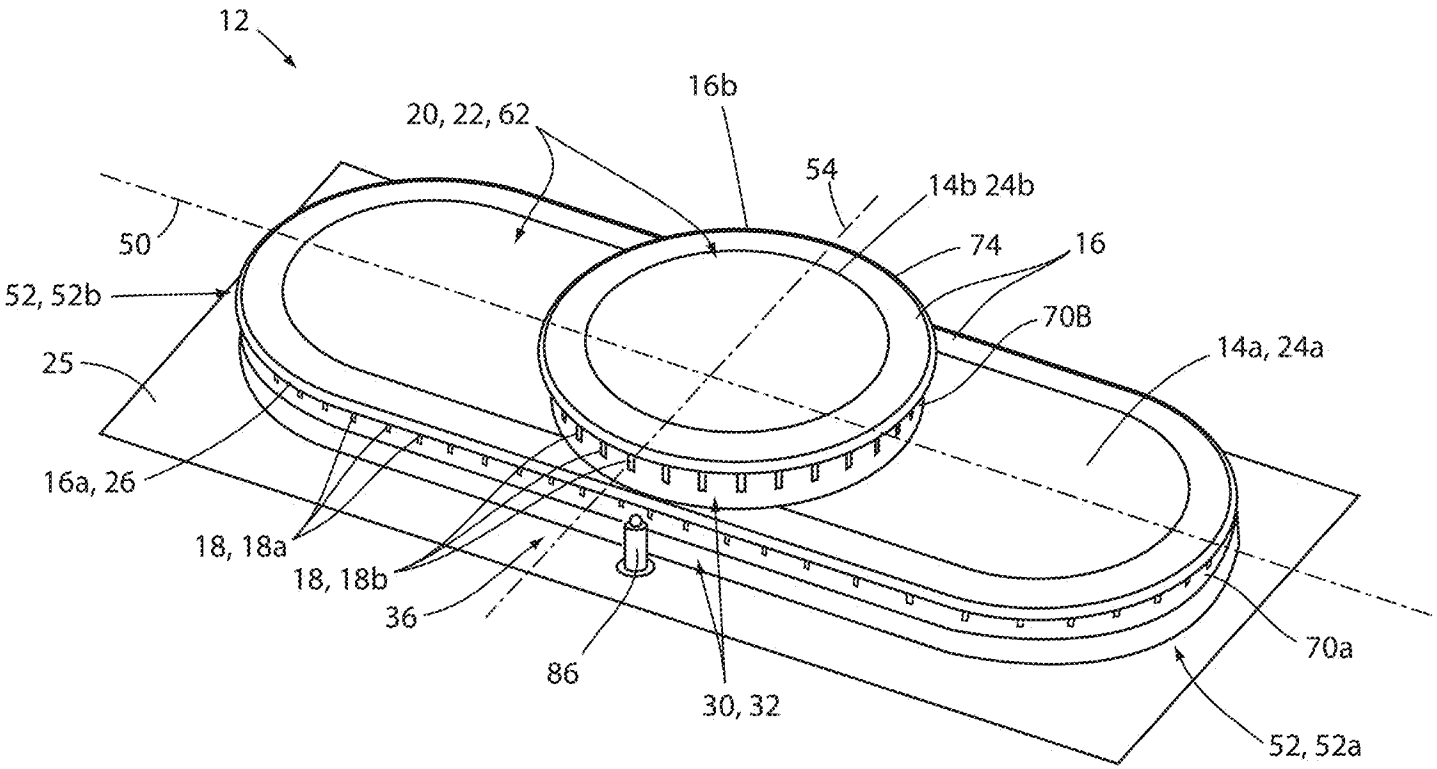
FIG. 3 is a detailed projected view of a combination burner assembly.
Figure 4:
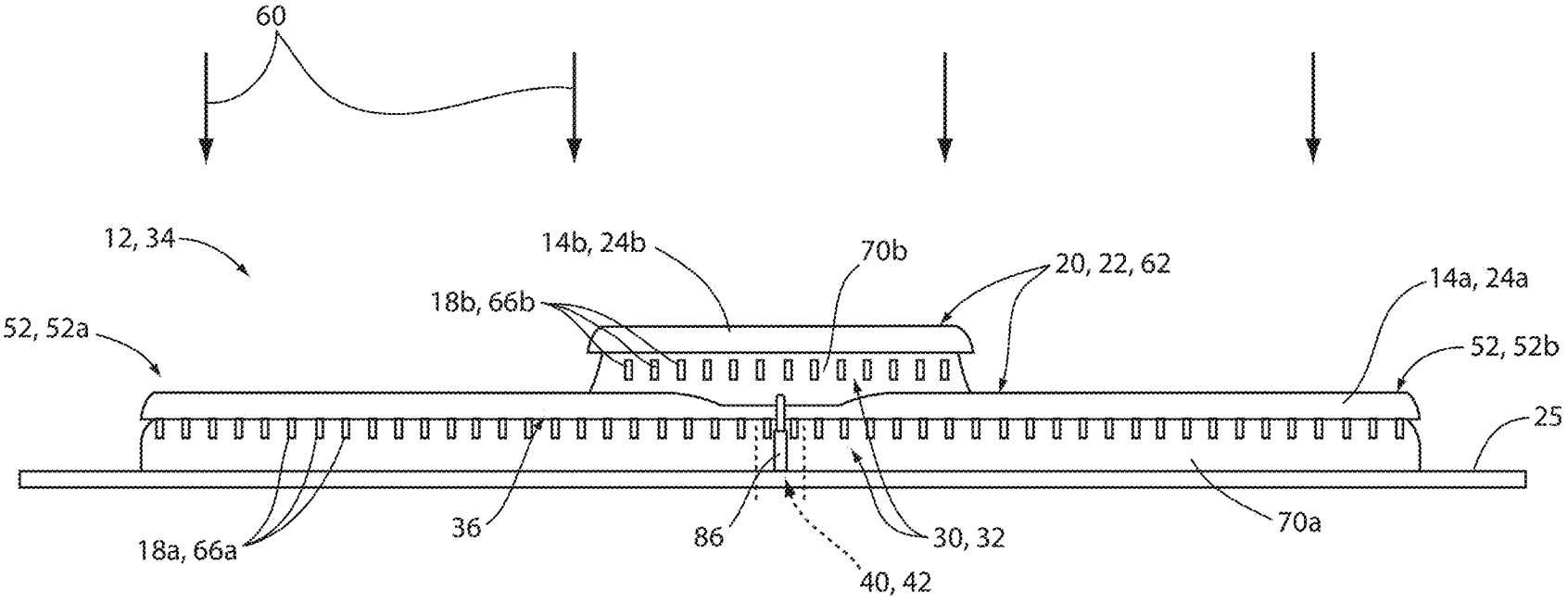
FIG. 4 is a side elevational view of a combination burner assembly.

Referring now to FIGS. 3 and 4, a projected view and a side profile view of the burner assembly are shown, respectively. As demonstrated in FIG. 3, the continuous heat delivered from the profile shapes 16*a* and 16*b* is provided in part by the stacked configuration 30 of the second burner 14*b* positioned above and supported by the first burner 14*a*. In this configuration, overlapping portions 32 of the profile shapes 16*a*, 16*b* forming the union 22 of the burners 14*a*, 14*b* are uninterrupted. That is, the stacked configuration 30 of the second burner 14*b* provides for the corresponding second burner ports 18*b* to be elevated above the first burner ports 18*a* of the first burner 14*a*. The overlapping portions 32 occupy the same surface area of the cooktop surface 25 without interference or interruption of either of the burners 14*a*, 14*b*. In this configuration, heat is consistently delivered about each of the profile shapes 16*a*, 16*b* to ensure consistent heat distribution to overlying cookware.

As demonstrated in FIG. 4, the stacked configuration 30 also provides an uninterrupted embossed or vertically protruding elevational profile 34 without breaks or openings. The primary issue identified with other designs considered when conceiving and testing the burner assembly 12 was that openings in the burner assembly 12, particularly between the first burner 14*a* and the second burner 14*b*, create spaces that collect waste and spillage associated with use of the cooking appliance 10. The collection of such cooking debris can result in serious degradation in the longevity of the burner assembly 12 resulting from buildup of debris. Alternatively, avoiding the buildup of such debris may require labor intensive cleaning resulting from hardships in accessing the spaces for cleaning and maintenance. Beneficially, the combination burner assembly 12 provides for the implementation of the first burner 14*a* with the second burner 14*b* having the vertically or upward-directed contiguous surface 20. In this configuration, burners 14*a*, 14*b* can be combined without creating narrow openings, thereby preserving easy cleaning and maintenance.

In the example shown, the first profile shape 16*a* is ovular and the second profile shape 16*b* is circular. As described herein, ovular may refer to an elongated circular or elongated, rounded body that may have a shape similar to an oval. In this configuration, elongated side portions 36 of the first profile shape 16*a* are aligned tangentially along the circular perimeter shape of the second profile shape 16*b*. Though circular and oval shapes are discussed in detail, the shapes forming the combination burner assembly 12 may include various polygonal shapes that may only be limited by manufacturing expense and reasonable manufacturability considerations. Accordingly, the overlapping portions 32 and complementary nature of the first and second profile shapes 16*a*, 16*b* of the first burner 14*a* and the second burner 14*b* are not obligatory to maintain the various benefits of the inventive subject matter. More generally, nearly any combination of shapes may be implemented for the first profile shape 16*a* and the second profile shape 16*b* while maintaining the contiguous surface 20 by elevating the second burner 14*b* above the first burner 14*a* as provided by the disclosure.

In some aspects, the first burner 14*a* covers a larger surface area than the second burner 14*b* over the cooktop surface 25. This configuration provides for the first profile shape 16*a* to extend beyond or have the perimeter 26 coextensive relative to the second profile shape 16*b*. The overlapping portions 32 of the second profile shape 16*b* with the second profile shape 16*a* allow a fuel supply 40 or Venturi assembly of the second burner 14*b* to pass through an opening 42 formed in the body of the first burner 14*a*. The opening 42 in the first burner 14*a* is best illustrated in the exploded assembly view shown in FIG. 5. This configuration not only facilitates the operation of the stacked burners 14*a*, 14*b* but also provides for combination burner assembly 12 to be implemented as a modular assembly of the cooking appliance 10 with a base or orifice holder that can interchangeably be replaced by the first burner 14*a* without the additional stacked burner. Additionally, the shape and proportions of the second burner 14*b* may be changed without requiring changes to the orifice holder or the cooktop surface 25 and included components.

Referring now to FIGS. 2-5, further details of the configuration of the burner assembly 12 and the profile shapes 16*a*, 16*b* are discussed in further detail. As demonstrated in each of FIGS. 2-5, the first profile shape 16*a* may generally correspond to an elongated, ovular shape with a major axis 50 along which a first side portion 36*a* and a second side portion 36*b* forming the side portions 36 extend. In this configuration, the major axis 50 may bisect the second profile shape 16*b*, which may correspond to a round shape. Distal end portions of each of the elongated side portions 36 of the first profile shape 16*a* may generally correspond to rounded segments 52 that enclose the elongated side portions 36 along a minor axis 54. More specifically, the rounded segments 52 may correspond to a third side portion 52*a* and a fourth side portion 52*b* that enclose the first profile shape 16*a* along the minor axis 54. In this configuration, the elongated side portions 36 may extend tangentially from the perimeter of the second profile shape 16*b*, such that the second cap 24*b* extends outward from the first cap 24*a* and provides for the vertically contiguous surface 20 of the burner assembly 12.

In various implementations, the first profile shape 16*a* is elongated and extends outward from the second profile shape 16*b*, such that a cooking surface of the burner assembly 12 may optionally be extended by activating the first burner 14*a* rather than the second burner 14*b*. Put differently, the first burner 14*a* provides for a larger heating surface area than the second burner 14*b*. The larger cooking or heating surface area of the first burner 14*a* may beneficially provide for improved heat distribution from the burner assembly 12 over the enlarged surface area corresponding to the first profile shape 16*a*. Alternatively, the smaller profile shape 16*b* of the second burner 14*b* may provide for increased intensity and heat delivery to corresponding cookware overlying the second profile shape 16*b*. Accordingly, the combination burner assembly 12 may provide for variable operation to suit and customize heat delivery for different cooking operations.

Referring now to FIG. 4, the stacked configuration 30 of the burner assembly 12 is demonstrated in further detail. As shown by arrows representing a vertical or gravitational vector 60, the overlapping portions of the profile shapes 16*a*, 16*b* that form the stacked configuration 30 provide for the vertically contiguous surface 20 of the burner assembly 12. That is, the first cap 24*a* and the second cap 24*b* form the vertically contiguous surface 20, such that cooking debris that falls onto the burner assembly 12 along the gravitational vector 60 is displaced from a spill surface 62 outward to the perimeter 26 of the burner assembly 12. Accordingly, food debris and spillage may fall on the spill surface 62 of the burner assembly 12 and/or be distributed outward to the perimeter 26 and over the surrounding cooktop surface 25. In this arrangement, the stacked configuration 30 of the profile shapes 16*a* and 16*b* provide for the vertically contiguous surface 20, which may ensure that the spill surface 62 is enclosed and free of openings, slots, and/or pockets which may otherwise capture debris.

Still referring to FIG. 4, the first burner 14*a* may include first burner ports 18*a*. The second burner 14*b* may include second burner ports 18*b*. The first burner ports 18*a* may extend about the first profile shape 16*a* and the second burner ports 18*b* may extend about the second profile shape 16*b*. The first burner ports 18*a* are distributed in a first arrangement 66*a* having a first distribution and spacing extending along the first profile shape 16*a*. The second burner ports 18*b* are distributed in a second arrangement 66*b* having a second distribution and spacing extending about the second profile shape 16*b*. While the arrangements 66*a*, 66*b* of the burner ports 18*a*, 18*b* may vary somewhat about the profile shapes 16*a*, 16*b*, each of the arrangements 66*a*, 66*b* of the burner ports 18*a*, 18*b* are uninterrupted over the overlapping portions 32 of each of the profile shapes 16*a*, 16*b*. In other words, the first arrangement 66*a* and the second arrangement 66*b* extend consistently along the overlapping portions 32 of the profile shapes 16*a*, 16*b* without break or interruption. Such a configuration is made possible by the stacked configuration 30 as demonstrated by the elevational profile 34.

Figure 5:
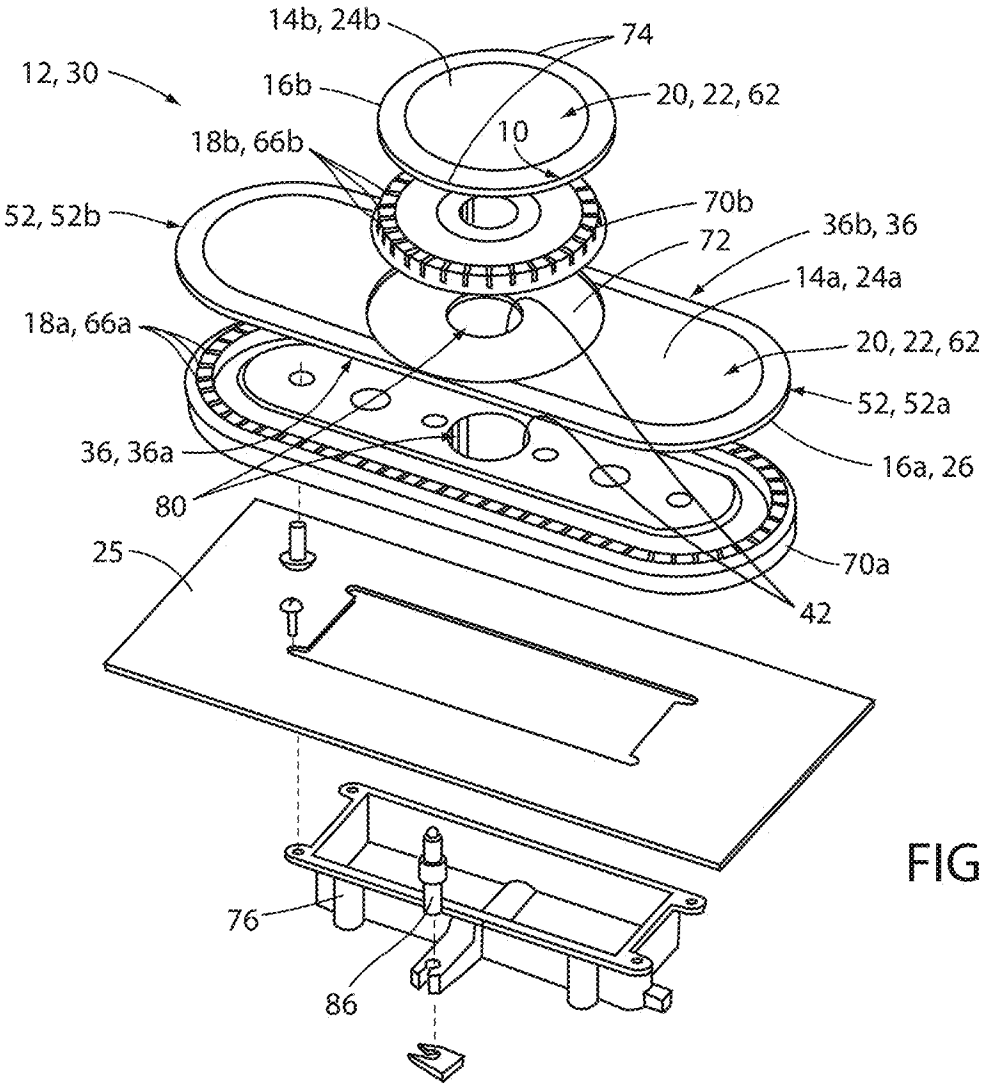
FIG. 5 is a projected, exploded assembly view of a burner assembly.

Referring now to FIG. 5, a projected, exploded view of the burner assembly 12 is shown demonstrating further details of the first burner 14*a* and the second burner 14*b*. As shown, the second cap 24*b* encloses an upward-directed surface of a second spreader 70*b*. The second spreader 70*b* may operate in combination with the second cap 24*b* to distribute fuel and heating flames about the second burner ports 18*b* along the second profile shape 16*b*. The second spreader 70*b* is arranged in the stacked configuration 30 on top of a support surface 72 formed on the first cap 24*a*. In this configuration, the second burner 14*b* is elevated above the first burner 14*a* by the support surface 72 of the first cap 24*a*. The stacked configuration 30 provides for the contiguous surface 20, which extends the spill surface 62 to prevent debris and spillage from gathering between the first and second burners 14*a*, 14*b*.

As discussed at length, the first burner 14*a* may form a base that supports the second burner 14*b*. Accordingly, a first spreader 70*a* of the first burner 14*a* is covered by the first cap 24*a*. In this configuration, the first burner ports 18*a* of the first burner 14*a* may extend along the first profile shape 16*a* under the first cap 24*a*. Accordingly, the first spreader 70*a* and the first cap 24*a* may extend along the first profile shape 16*a*, such that the first burner ports 18*a* conform to the first profile shape 16*a*. Similarly, the second spreader 70*b* and the second cap 24*b* may generally conform to the second profile shape 16*b*, such that the second burner ports 18*b* of the second burner 14*b* conform to the second profile shape 16*b*. The overlapping portions 32 of the stacked configuration 30 of the burners 14*a*, 14*b* are shown along the elongated side portions 36 that extend tangentially to rounded perimeter extents 74 of the second profile shape 16*b*.

The first spreader 70*a* may be mounted to the cooktop surface 25, which may further be aligned and in connection with an orifice holder 76 of the burner assembly 12. In this configuration, supply gas to operate each of the burners 14*a*, 14*b* may be supplied via one or more supply lines from a control valve to independently control the gas flow to each of the burners 14*a*, 14*b*. The supply gas for the second burner 14*b* may be delivered through a body of the first burner 14*a* including the first spreader 70*a* and the first cap 24*a*. More specifically, a supply aperture 80 may be formed through the first spreader 70*a* and the first cap 24*a* within the perimeter 26 and the second profile shape 16*b*. In this configuration, the supply gas for the second burner 14*b* may be delivered to the second spreader 70*b* through the supply aperture 80, such that the supply gas can be delivered to the second burner 14*b* in the stacked configuration 30.

An ignition electrode 86 is generally demonstrated in FIGS. 3-5 and is positioned along one of the overlapping portions 32 of the profile shapes 16*a*, 16*b* of the burners 14*a*, 14*b*. In this configuration, the ignition electrode 86 may provide an ignition spark to both of the first and second burners 14*a*, 14*b* for ignition. The position of the ignition electrode 86 along the overlapping portion 32 may limit a need for separate ignition electrodes for each of the burners 14*a*, 14*b*.

Figure 6B:
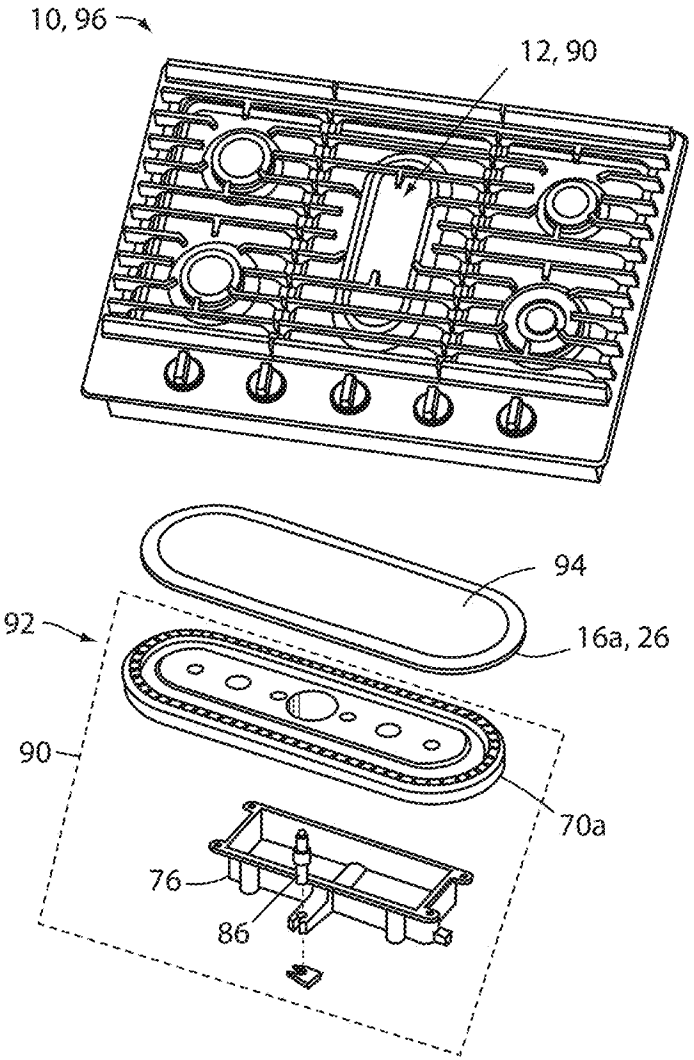
FIG. 6B is a projected view of a second exemplary interchangeable burner assembly.
Figure 6A:
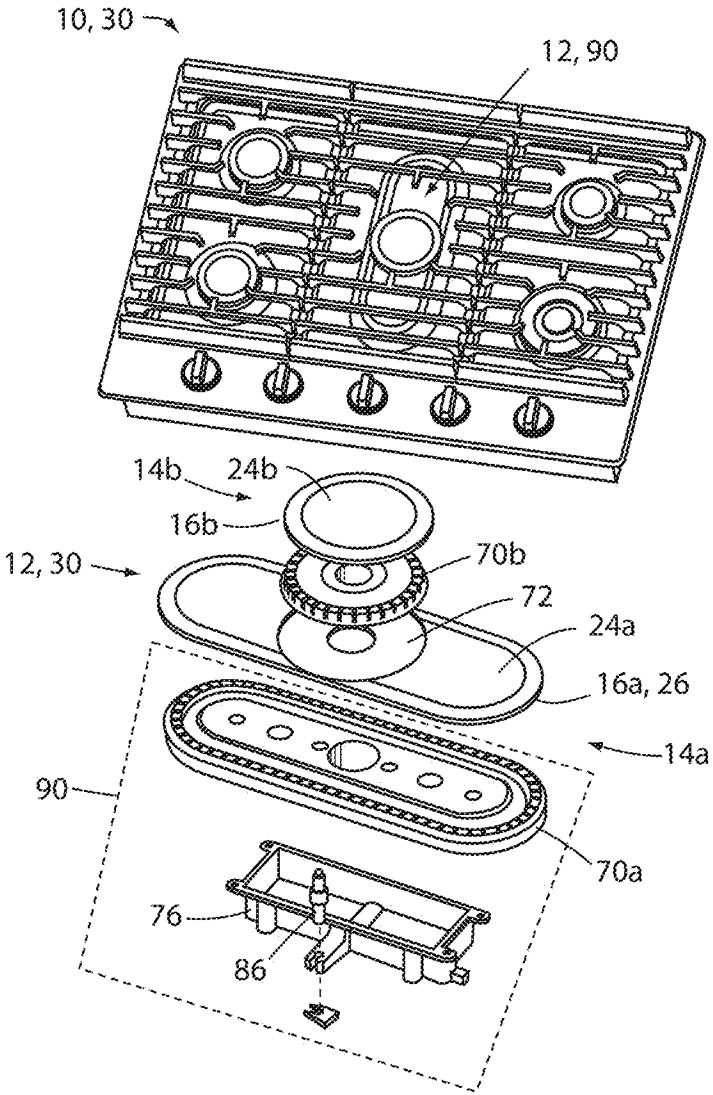
FIG. 6A is a projected view of a first exemplary interchangeable burner assembly.

Referring now to FIGS. 6A and 6B, the burner assembly 12 may provide for interchangeable modular burner assemblies 90, such that common components may be utilized for the cooking appliance 10 while interchanging the dual burner configuration provided by the burners 14*a*, 14*b* with an alternate third burner 92. The burner assembly shown in FIG. 6A corresponds to the stacked configuration 30, including the first burner 14*a* and the second burner 14*b*. The configuration shown in FIG. 6B is a single burner configuration 96 that includes the same first spreader 70*a* implemented in the stacked configuration 30. Accordingly, the third burner shown in FIG. 6B may share the first spreader 70*a* as well as the connection to the cooktop surface 25 and the orifice holder 76 with the first burner 14*a*. As a result of the stacked configuration 30, only the first cap 24*a* of the first burner 14*a* may necessarily be exchanged to provide for the single burner configuration 96 of the third burner 92. That is, the first cap 24*a* of the first burner 14*a* may be modified by eliminating the support surface 72 and the supply aperture 80, such that a third cap 94 encloses the entirety of the first profile shape 16*a*. Accordingly, the interchangeable nature of the modular burner assemblies 90 may provide for improved efficiency in manufacturing by allowing for shared components.

Figure 7A:
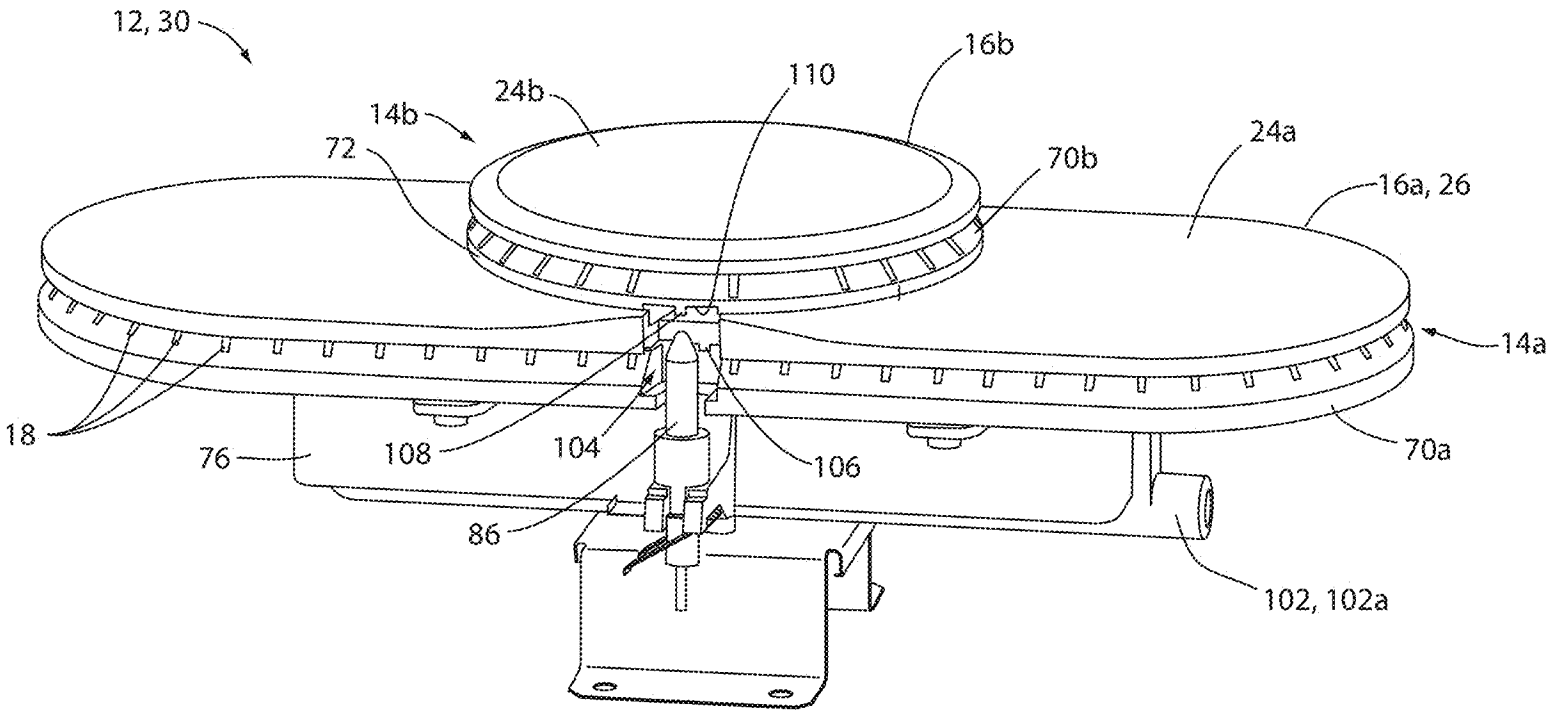
FIG. 7A is a projected view of a combination burner assembly.
Figure 7B:
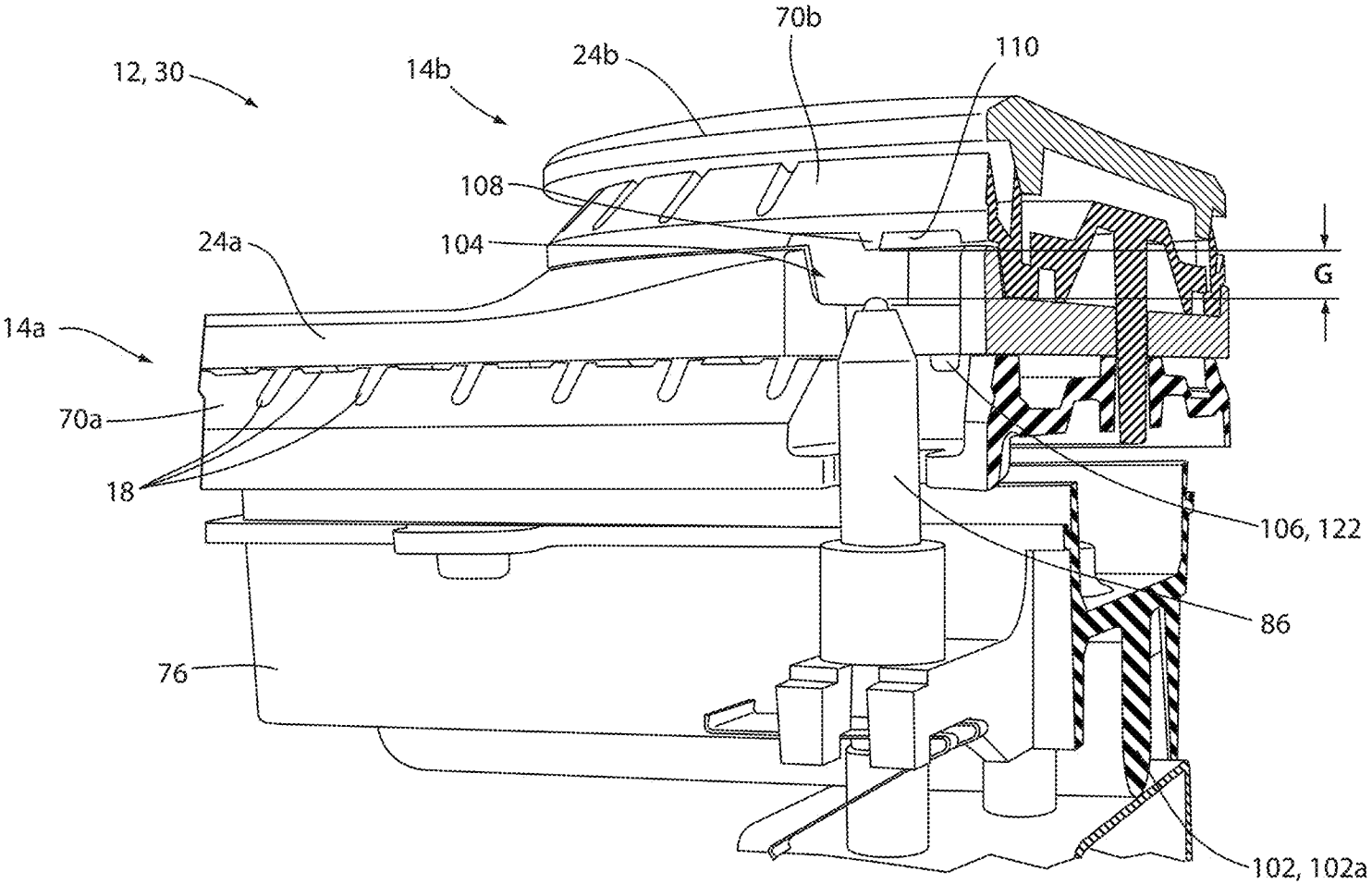
FIG. 7B is a partial cutaway, projected view of the burner assembly demonstrated in FIG. 7A.

Referring now to FIGS. 7A and 7B, a detailed example of the burner assembly 12 is shown demonstrating an improved ignition and fuel delivery apparatus. The example of the burner assembly 12 introduced in FIGS. 7A and 7B continues in reference to FIGS. 8, 9A, 9B, and 10. For clarity, common reference numerals are utilized to reference similar components to those previously introduced in FIGS. 1-6B. Each of the elements discussed in reference to the various examples described in the application shall be understood to be optionally implemented and combined in various ways to suit the desired design for the burner assembly 12 as disclosed. Accordingly, the beneficial features of the ignition and fuel delivery apparatus may be implemented in the earlier examples presented in this application, as well as similar devices that will be understood by those skilled in the art.

As demonstrated in FIG. 7A, the burner assembly 12 is demonstrated in the stacked configuration 30. Accordingly, the first or lower spreader 70*a* is partially enclosed over an upper surface by the first cap 24*a*. Additionally, the support surface 72 of the first cap 24*a* supports the second spreader 70*b*, which is partially enclosed over an upper surface by the second cap 24*b*. The burner assembly 12 may be supplied with fuel via one or more fuel supply inlets 102 received by the orifice holder 76. Accordingly, the burner assembly 12 demonstrated in FIG. 7A provides for a similar design, including the first and second profile shapes 16*a*, 16*b*, as well as the vertically contiguous surface 20 formed by the union 22 of the first cap 24*a* of the first burner 14*a* and the second cap 24*b* of the second burner 14*b*.

Referring now to FIG. 7B, a cutaway view of the burner assembly 12 further demonstrates the fuel delivery configuration of the burners 14*a*, 14*b*. As shown, the ignition electrode 86 is positioned centrally within a combined ignition aperture 106 configured to ignite either the first burner 14*a* or the second burner 14*b* depending on the fuel delivery from the orifice holder 76. As further described in reference to FIGS. 8 and 9A, the burner ports 18 of each of the first burner 14*a* and the second burner 14*b* are ignited via the activation of the ignition electrode 86 in combination with fuel delivered to a corresponding ignition port 106 as well as the surrounding burner ports 18 of each of the burners 14*a*, 14*b*. In operation, the fuel delivered via the ignition ports 106 is directed through the combined ignition aperture 104 toward a spark gap G. Spark gap G is defined by a space between a distal end portion of the ignition electrode 86 and a receiving arc terminal 108, which is integrally formed from the second or upper spreader 70*b*. In this configuration, the fuel from the orifice holder 76 is effectively delivered from the ignition ports 106 into the combined ignition aperture 104 to selectively ignite the burner ports 18 for each of the burners 14*a*, 14*b*.

Figure 8:
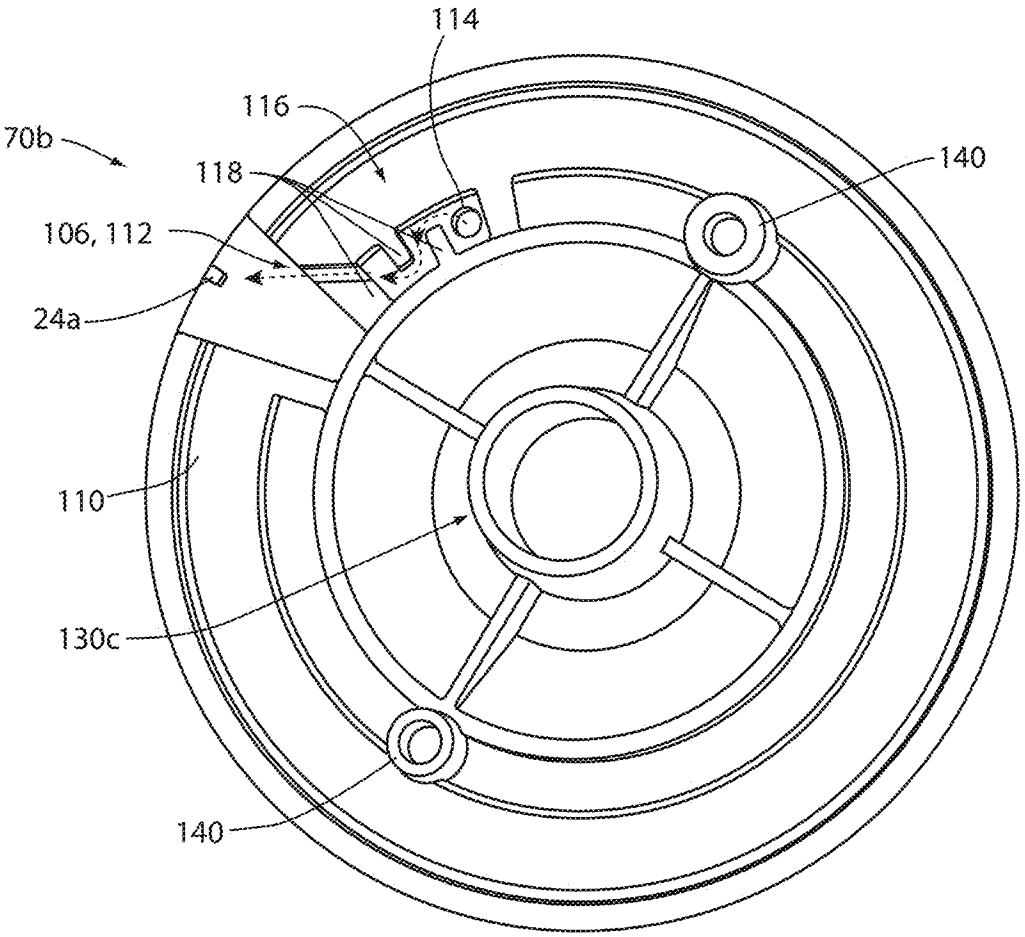
FIG. 8 is a bottom view of a second or upper spreader of the burner assembly.

As demonstrated in FIG. 8, the receiving terminal 108 extends downward from a bottom surface 110 of the second spreader 70*b* into a perimeter wall of the combined ignition aperture 104. The ignition port 106 of the second spreader 70*b* may be referred to as an upper ignition port 112 that is supplied with fuel via a supply aperture that may pass through the body of the second spreader 70*b* from a top surface to the bottom surface depicted. The supply aperture 114 is in fluid connection with a chamber labyrinth 116 formed by a recessed passage formed in the bottom surface 110 of the second spreader 70*b*. As demonstrated, the chamber labyrinth 116 is formed along a tortuous path comprising a plurality of switchback turns formed by intermediate barrier walls 118. In operation, the chamber labyrinth 116 limits the velocity of the fuel output via the upper ignition port 112 to prevent excess fuel being dispersed beyond the combined ignition aperture 104, which may result in ignition flashes. Accordingly, the chamber labyrinth 116 provides for the controlled delivery of the fuel into the combined ignition aperture 104 via the upper ignition port 112.

Figure 9A:
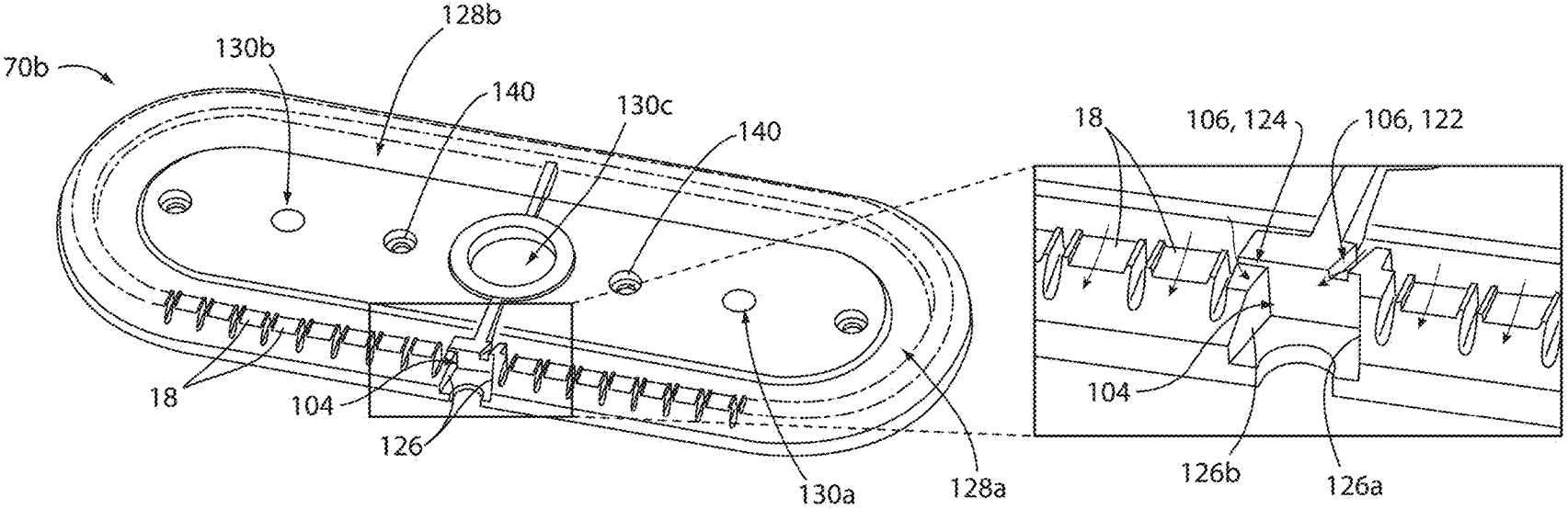
FIG. 9A is a top projected view of a first or lower spreader of the burner assembly.

Referring now to FIG. 9A, the first or lower spreader 70*a* is demonstrated in further detail. In the example shown, the ignition ports 106 of the burner assembly 12 may further include a lower ignition port 122 and/or a carryover port 124. In the example shown, the lower ignition port 122 may provide for the primary supply of fuel into the combined ignition aperture 104 to be ignited by the ignition electrode 86. Though the primary or lower ignition port 122 may supply sufficient fuel into the combined ignition aperture 104 to achieve ignition of the first burner 14*a*, the carryover port 124 may be implemented to insure that the ignition occurs across opposing sides 26 of the combined ignition aperture 104. Accordingly, the lower ignition port 122 may be biased or positioned within the first spreader 70*a* proximate to a first side 126*a* and the carryover port 124 may be formed in the second spreader 70*b* proximate to a second side 126*b*. In this configuration, the fuel delivered from the orifice holder 76 may pass through first and second spreader reservoirs 128*a*, 128*b*, which may be formed between the first spreader 70*a* and the first cap 24*a*. In this configuration, fuel is delivered into the spreader reservoirs 128*a*, 128*b* and passes outward through each of the lower ignition port 122, the carryover ports 124, and the burner ports 18 of the first burner 14*a*. The combined fuel delivery via the lower ignition port 122 and the carryover port 124 may provide for the fuel to be distributed across the opposing sides 126 within the combined ignition aperture 104, such that the neighboring burner ports 18 adjacent to each of the opposing sides 126 are ignited nearly simultaneously. For clarity, the output of the fuel to the lower ignition port 122, carryover port 124, and the burner ports 18 is demonstrated in the detailed view of FIG. 9A by the representative arrows.

Figure 9B:
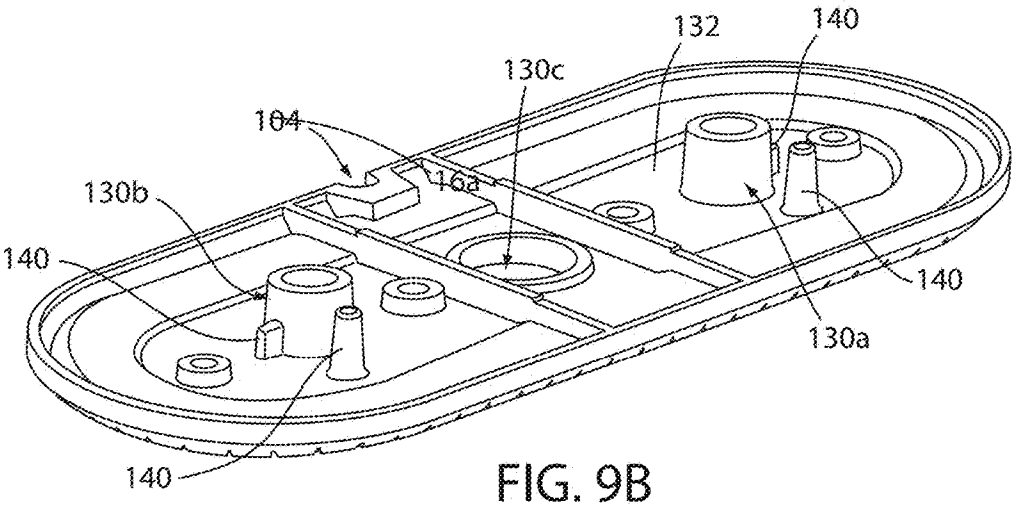
FIG. 9B is a bottom projected view of the first or lower spreader demonstrated in FIG. 9A.
Figure 10:
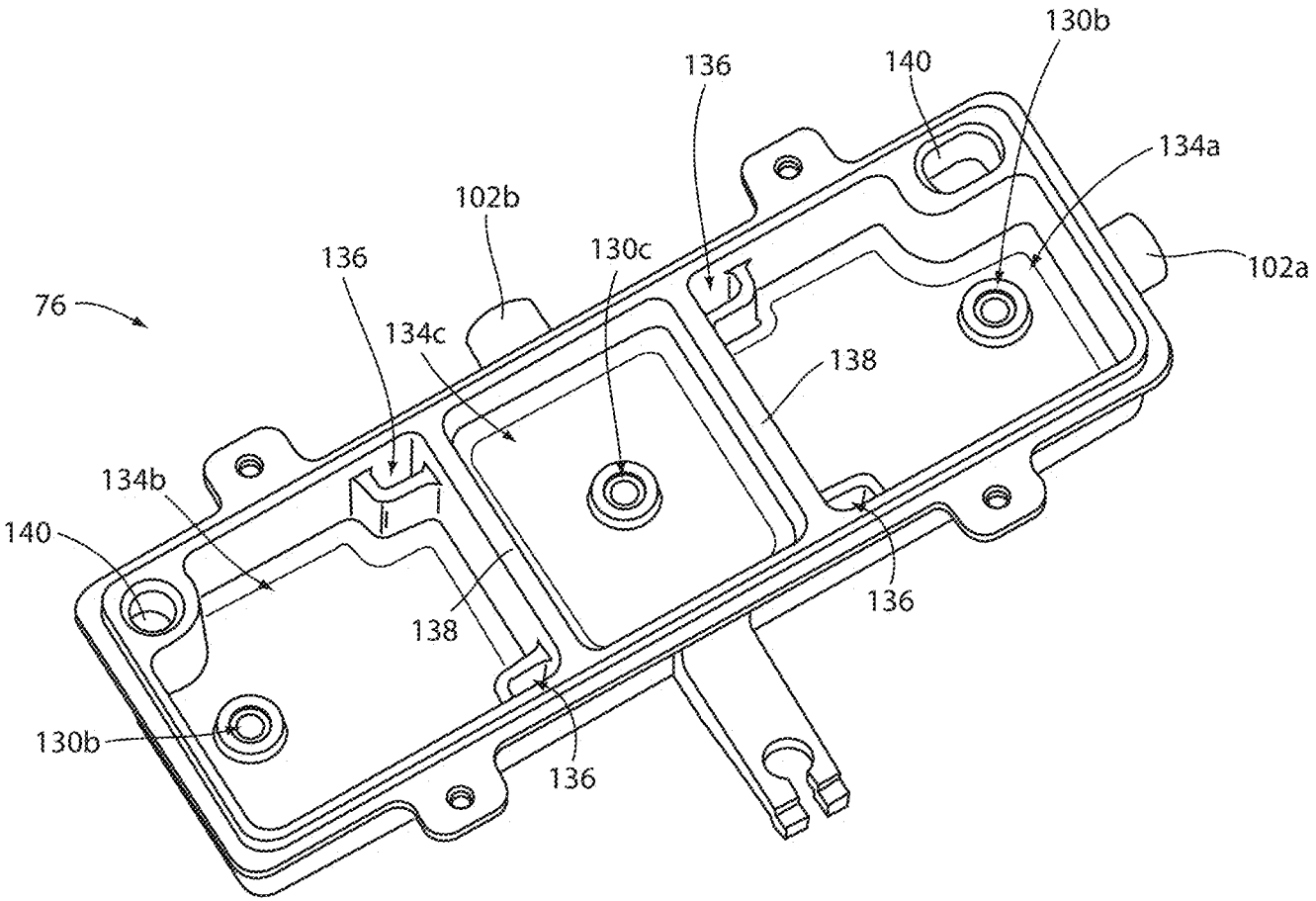
FIG. 10 is a projected view of an orifice holder in accordance with the disclosure.

Referring now to FIGS. 9A, 9B, and 10, the first spreader reservoir 128*a* and the second spreader reservoir 128*b* are supplied with fuel via a corresponding first supply port 130*a* and a second supply port 130*b*, respectively. The supply ports 130 may extend from a bottom surface 132 of the first spreader 70*a* and protrude into a corresponding first chamber 134*a* and second chamber 134*b* of the orifice holder 76, as depicted in FIG. 10. As demonstrated, a third chamber 134*c* may be formed centrally between the first chamber 134*a* and the second chamber 134*b*. The third chamber 134*c* may deliver fuel through the second supply inlet 102*b* (See, FIG. 10) into the third supply port 130*c* formed centrally through the second spreader 70*b*. In this configuration, fuel may be supplied into the orifice holder 76 via the supply inlets 102*a*, 102*b* to independently supply fuel to the first spreader 70*a* via a first supply inlet 102*a* and to the second spreader 70*b* via a second supply inlet 102*b*.

Though not clearly depicted in FIG. 10, the first supply inlet 102*a* delivers fuel into each of the first chamber 134*a* and the second chamber 134*b*. The fuel delivered into the supply chambers 134*a*, 134*b* is then mixed with air drawn into the supply chambers 134*a*, 134*b* through a plurality of air inlets 136. The air inlets 136 are formed through the base of the orifice holder 76 proximate to an interior wall 138 that separates the first chamber 134*a* and the second chamber 134*b* from the third chamber 134*c* positioned therebetween. The air inlets 136 are formed through the base of the orifice holder 76 on a side opposing the corresponding supply port 130*a*, 130*b*. In this configuration, the fuel supplied into the supply chambers 134*a*, 134*b* is mixed with atmospheric air local (e.g., below) the orifice holder to aerate the fuel and improve the combustion efficiency of the flames produced via the burner ports 18 distributed about the perimeter 26 of the burner assembly 12.

As shown in FIG. 10, the supply chambers 134*a*, 134*b*, 134*c* are separated by interior walls 138 that form partitions between the supply chambers 134*a*, 134*b*, 134*c*. The walls 138 prevent or limit the recirculation of flue gases that may otherwise be drawn into the orifice holder and mixed with supply gas for an active burner (e.g., the first burner 14*a*) via the burner ports 18 and supply port of an inactive burner (e.g., the second burner 14*b*). More specifically, the flue gases output due to the burnt fuel and air from the first burner 14*a* may have elevated carbon monoxide levels and depleted oxygen levels. The flue gas may then be drawn into the burner ports of the second burner 14*b* (e.g., the inactive burner), through the central or third supply port 130*c* and into the orifice holder 76 during the operation of the first burner 14*a* (e.g., the active burner). The result of the recirculation is that the fuel supplied to the first burner 14*a* (e.g., the active burner) will cause a reduced efficiency in combustion. By separating the supply chambers 134*a*, 134*b*, 134*c* with the walls 138, the path for recirculation between the inactive burner and the active burner is obstructed, such that the flue gases are not introduced into the fuel supply to the active burner. Accordingly, the walls 138 separating the supply chambers 134*a*, 134*b*, 134*c* provide for prevention of recirculation of air via the inactive burner of the first and second burners 14*a*, 14*b*.

Still referring to FIGS. 9A, 9B, and 10, each of the supply ports 130 may be aligned within the chambers 134 of the orifice holder 76 by one or more positioning features 140. As depicted in FIG. 9B, the positioning features 140 may correspond to one or more protrusions or alignment protrusions that may be received by corresponding alignment apertures formed within the orifice holder 76. The engagement of the protrusions with the apertures of the positioning features 140 may align the supply ports 130 with the corresponding chambers of the orifice holder 76. In this configuration, the first spreader 70*a* may be placed in alignment with the orifice holder 76, such that the spreaders 70 and caps 24 of the burner assembly 12 may be readily positioned for ease of assembly.

In addition to the positioning features 140 demonstrated in FIGS. 9B and 10, additional positioning features may be incorporated in the second spreader 70*b* as demonstrated in FIG. 8. As shown, the positioning features 140 demonstrated in the second spreader 70*b* correspond to alignment apertures that are configured to receive corresponding alignment protrusions extending upward from the support surface 72 of the first cap 24 as previously discussed. Though described in specific configurations in reference to protrusions and apertures, it shall be understood that the positioning features 140 incorporated on the spreaders 70, caps 24, and the orifice holder 76 may be interchangeably implemented and arranged in various ways to align the components of the burner assembly 12. Accordingly, variations in the alignment interaction of the positioning features 140 may be implemented without departing from the spirit of the disclosure.

The device disclosed herein is further summarized in the following paragraphs and is further characterized by combinations of any and all of the various aspects described therein.

According to one aspect of the present disclosure, a combination gas burner assembly is disclosed. The assembly comprises a first burner forming a first profile shape and a second burner positioned above the first burner. The second burner forms a second profile shape different from the first profile shape. The first burner and the second burner form a perimeter profile of the gas burner assembly. The first profile shape overlaps with the second profile shape forming an overlapping portion of the perimeter.

According to another aspect, the first profile shape is an elongated shape with a major axis that bisects the second profile shape.

According to another aspect, the first profile shape is an elongated shape with a larger vertically facing surface area over the cooking surface than the second profile shape.

According to another aspect, the first profile shape extends outward from the second profile shape along a major axis of the elongated shape.

According to another aspect, the second profile shape comprises elongated side portions extending along a first side and a second side that opposes the first side.

According to another aspect, the elongated side portions of the first profile shape are aligned tangentially with a circular perimeter of the second profile shape.

According to another aspect, the elongated shape comprises a third side and a fourth side in connection with the elongated side portions, wherein the third side opposes the fourth side and each of the third side and fourth side form rounded segments extending to enclose the elongated side portions along a minor axis.

According to another aspect, the second profile shape is round.

According to another aspect, the second profile shape is ovular.

According to another aspect, the overlapping portion of the perimeter over which the second profile shape overlaps the first profile shape is vertically stacked, such that second burner ports of the second burner extend above first burner ports of the first burner.

According to another aspect, the first burner comprises first burner ports extending about the first profile shape and the second burner comprises second burner ports extending about the second profile shape.

According to another aspect, the first burner ports are distributed in a first arrangement about the first profile shape and the second burner ports are distributed in a second arrangement about the second profile shape, wherein the first arrangement and second arrangement extend consistently along the overlapping portion of the first profile shape and the second profile shape.

According to another aspect, the first arrangement comprises a first distribution and a first spacing of the first burner ports, and the second arrangement comprises a second distribution and a second spacing of the second burner ports.

According to another aspect, the first spacing of the first burner ports and the second spacing of the second burner ports are uninterrupted along the overlapping portion of the first profile shape and the second profile shape.

According to another aspect of the present disclosure, a combination gas burner assembly is disclosed. The assembly comprises a first burner forming a first profile shape. The first burner comprises ports extending up about the first profile shape in a first arrangement. A second burner is positioned above the first burner and forms a second profile shape different from the first profile shape. The second burner comprises second burner ports extending about the second profile shape in a second arrangement. The first burner and the second burner form a perimeter profile of the gas burner assembly. The first profile shape overlaps with the second profile shape forming an overlapping portion of the perimeter. The first arrangement and the second arrangement of the burner ports extend consistently along the overlapping portion of the first profile shape and the second profile shape.

According to another aspect, the first burner comprises a first cap and the second burner comprises a second cap, wherein the first cap and the second cap form a vertically or upward-directed contiguous surface formed by a union of the first cap and the second cap.

According to another aspect, the first arrangement comprises a first distribution and a first spacing of the first burner ports and the second arrangement comprises a second spacing and a second distribution of the second burner ports.

According to another aspect, the first arrangement and the second arrangement are uninterrupted along the overlapping portions of the first profile shape and the second profile shape.

According to yet another aspect of the present disclosure, a combination gas burner assembly comprises a first burner forming a first profile shape and a second burner positioned above the first burner. The second burner forms a second profile shape different from the first profile shape. The first burner and the second burner form a perimeter of the gas burner assembly. The first profile shape overlaps with the second profile shape forming an overlapping portion of the perimeter. The first profile shape is an elongated shape with a larger vertically facing surface area over the cooking surface than the second profile shape. The first profile shape extends outward from the second profile shape along a major axis of the elongated shape. The overlapping portion of the perimeter over which the second profile overlaps the first profile shape is vertically stacked, such that the second burner ports of the second burner extend above the first burner ports of the first burner.

According to another aspect, the first profile shape comprises elongated side portions that are aligned tangentially with the second profile shape.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A combination gas burner assembly comprising:

a first burner forming a first profile shape;

a second burner positioned above the first burner and forming a second profile shape different from the first profile shape, wherein the first burner and the second burner form a perimeter of the gas burner assembly and the first profile shape overlaps with the second profile shape forming an overlapping portion of the perimeter; and wherein the overlapping portion of the perimeter over which the second profile shape overlaps the first profile shape is vertically stacked, such that second burner ports of the second burner extend above first burner ports of the first burner.

2. The burner assembly according to claim 1, wherein the first profile shape is an elongated shape with a major axis that bisects the second profile shape.

3. The burner assembly according to claim 1, wherein the first profile shape is an elongated shape with a larger vertically facing surface area over the cooking surface than the second profile shape, and wherein the first profile shape extends outward from the second profile shape along a major axis of the elongated shape.

4. The burner assembly according to claim 3, wherein the first profile shape comprises elongated side portions extending along a first side and a second side that opposes the first side.

5. The burner assembly according to claim 4, wherein the elongated side portions of the first profile shape are aligned tangentially with a circular perimeter of the second profile shape.

6. The burner assembly according to claim 5, wherein the elongated shape comprises a third side and a fourth side in connection with the elongated side portions, wherein the third side opposes the fourth side and each of the third side and fourth side form rounded segments enclosing the elongated side portions along a minor axis.

7. The burner assembly according to claim 1, wherein the second profile shape is round, and the first profile shape is ovular.

8. The burner assembly according to claim 1, further comprising:

a third burner comprising the first profile shape, wherein the third burner comprises a top surface that encloses the first profile shape and is interchangeable with a stacked combination of the first burner and the second burner.

9. The burner assembly according to claim 1, wherein the first burner comprises first burner ports extending about the first profile shape and the second burner comprises second burner ports extending about the second profile shape, and wherein the first burner ports are distributed in a first arrangement about the first profile shape and the second burner ports are distributed in a second arrangement about the second profile shape, wherein the first arrangement and second arrangement extend consistently along the overlapping portion of the first profile shape and the second profile shape.

10. The burner assembly according to claim 1, wherein the first arrangement comprises a first distribution and a first spacing of the first burner ports, and the second arrangement comprises a second distribution and a second spacing of the second burner ports.

11. The burner assembly according to claim 10, wherein the first spacing of the first burner ports and the second spacing of the second burner ports are uninterrupted along the overlapping portion of the first profile shape and the second profile shape.

12. The burner assembly according to claim 1, wherein the first burner comprises a first cap and the second burner comprises a second cap, wherein the first cap and the second cap form an upward-directed contiguous surface.

13. A combination gas burner assembly comprising:

a first burner forming a first profile shape, wherein the first burner comprises first burner ports extending about the first profile shape in a first arrangement;

a second burner positioned above the first burner and forming a second profile shape different from the first profile shape, wherein the second burner comprises second burner ports extending about the second profile shape in a second arrangement; and wherein:

the first burner and the second burner form a perimeter of the gas burner assembly;

the first profile shape overlaps with the second profile shape forming an overlapping portion of the perimeter; and the first arrangement and the second arrangement extend consistently along the overlapping portion of the first profile shape and the second profile shape.

14. The burner assembly according to claim 13, wherein the first arrangement comprises a first distribution and a first spacing of the first burner ports and the second arrangement comprises a second spacing and a second distribution of the second burner ports.

15. The burner assembly according to claim 14, wherein the first arrangement and the second arrangement are uninterrupted along the overlapping portions of the first profile shape and the second profile shape.

16. A combination gas burner assembly comprising:

a first burner forming a first profile shape; and a second burner positioned above the first burner and forming a second profile shape different from the first profile shape; and wherein:

the first burner and the second burner form a perimeter of the gas burner assembly;

the first profile shape overlaps with the second profile shape forming an overlapping portion of the perimeter;

the first profile shape is an elongated shape with a larger vertically-facing surface area over the cooking surface than the second profile shape, wherein the first profile shape extends outward from the second profile shape along a major axis of the elongated shape; and the overlapping portion of the perimeter over which the second profile shape overlaps the first profile shape is vertically stacked, such that second burner ports of the second burner extend above first burner ports of the first burner.

17. The burner assembly according to claim 16, wherein the first profile shape comprises elongated side portions that are aligned tangentially with the second profile shape.

18. The burner assembly according to claim 1, wherein the overlapping portion is formed on two opposing sides of the first profile shape.

19. The burner assembly according to claim 1, wherein the first profile shape circumscribes the second profile shape forming the overlapping portion.

* * * * *